US006912829B2

(12) United States Patent
Costantini

(10) Patent No.: US 6,912,829 B2
(45) Date of Patent: Jul. 5, 2005

(54) METHOD FOR WRAPPING A FOOD PRODUCT

(75) Inventor: Maurizio Costantini, Alba (IT)

(73) Assignee: Soremartec S.A., Schoppach-Arlon (BE)

( * ) Notice: Subject to any disclaimer, the term of this patent is extended or adjusted under 35 U.S.C. 154(b) by 531 days.

(21) Appl. No.: 09/742,308

(22) Filed: Dec. 22, 2000

(65) Prior Publication Data

US 2001/0006692 A1 Jul. 5, 2001

(30) Foreign Application Priority Data

Dec. 22, 1999 (EP) ..... 99830789

(51) Int. Cl.[7] ..... B65B 43/08; B65B 11/50

(52) U.S. Cl. ..... 53/453; 53/452; 426/410; 426/392; 426/413

(58) Field of Search ..... 426/414, 515, 426/104, 410, 392, 413; 53/453, 478, 485, 486

(56) References Cited

U.S. PATENT DOCUMENTS

| | | | | | |
|---|---|---|---|---|---|
| 211,420 | A | * | 1/1879 | Moses | 426/104 |
| 1,382,601 | A | * | 6/1921 | Cressey | 426/104 |
| 1,383,290 | A | * | 7/1921 | Cressey | 426/104 |
| 1,777,896 | A | * | 10/1930 | Rossi | 426/515 |
| 1,800,990 | A | * | 4/1931 | Forrest | 426/104 |
| 2,038,584 | A | * | 4/1936 | McIlvaine | 426/90 |
| 2,053,238 | A | * | 9/1936 | Dulany | 426/104 |
| 2,082,671 | A | * | 6/1937 | Walker | 426/104 |
| 2,698,802 | A | * | 1/1955 | Boori | 426/104 |
| 2,796,033 | A | * | 6/1957 | Feinstein | 426/414 |
| 3,251,319 | A | * | 5/1966 | Kaupert et al. | 426/515 |
| 3,366,077 | A | * | 1/1968 | Gardner | 426/515 |
| 3,666,388 | A | * | 5/1972 | Ogerwelland et al. | 426/515 |
| 3,961,089 | A | | 6/1976 | Dogliotti | |
| 4,014,156 | A | * | 3/1977 | Klahn et al. | 426/414 |
| 5,308,630 | A | * | 5/1994 | Nordahl | 426/414 |
| 5,728,414 | A | * | 3/1998 | Terrasi | 426/104 |
| 5,792,496 | A | * | 8/1998 | Fekete | 426/104 |
| 5,925,391 | A | * | 7/1999 | Whetstone | 426/104 |
| 6,099,872 | A | * | 8/2000 | Whetstone | 426/104 |

FOREIGN PATENT DOCUMENTS

| | | | | |
|---|---|---|---|---|
| DE | 2324344 | * | 12/1974 | |
| EP | 349841 | * | 1/1990 | 426/104 |
| EP | 0 790 184 A1 | | 8/1997 | |
| FR | 835498 | * | 9/1937 | |
| FR | 1203203 | * | 7/1958 | |
| GB | 302303 | * | 12/1928 | 426/104 |
| GB | 416970 | * | 9/1934 | 426/104 |
| GB | 474396 | * | 11/1937 | 426/104 |
| GB | 670078 A | | 4/1952 | |
| GB | 2279286 | * | 1/1995 | 426/515 |
| WO | WO 93/00267 A1 | | 1/1993 | |
| WO | WO 93/01093 A1 | | 1/1993 | |
| WO | WO93/03624 | * | 3/1993 | 426/104 |

* cited by examiner

*Primary Examiner*—Steve Weinstein
(74) *Attorney, Agent, or Firm*—Rothwell, Figg, Ernst & Manbeck

(57) ABSTRACT

A method of wrapping in a sheet material a food product comprising at least two complementary parts coupled together along a coupling line includes the steps of:

Figure 1:
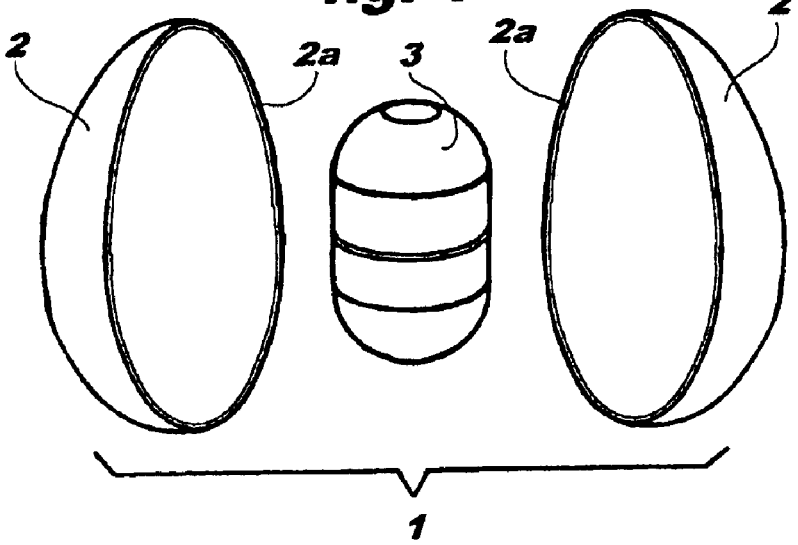

forming the wrapper in at least two complementary portions able to be connected along an associated connection line, positioning the said product in the said wrapper in such a way that the said coupling line is offset relative to the associated connection line with the said at least two parts coupled together substantially freely, and closing the said wrapper around the said product along the said connection line.

8 Claims, 2 Drawing Sheets

METHOD FOR WRAPPING A FOOD PRODUCT

The present invention relates in general to the problem of wrapping a food product in a sheet material.

Food products of this type are known in the art: such as, for example, the so-called "Easter eggs" commonly sold in numerous European and other countries, or, to mention a mass-market product, the items sold under the name "Uovo Kinder" by companies of the Ferrero group. If such products are hollow, they lend themselves to holding containers which are used to carry a "surprise": see in this context the arrangement described in WO-A-93/00267.

In particular, U.S. Pat. No. 3,961,089 describes a method of manufacturing a hollow egg-shaped food product by sealing together two half-shells along a line defining the respective mouth portions. A substantially similar end result, that is sealing the two half-shells along their respective mouth portions, can be achieved by other methods, for example by locally softening the said portions of the material constituting the product casing. Once the said mouth portions have been softened, they are fitted together and subsequently sealed as a result of the cooling and hardening of the material.

The aforesaid products are generally intended to be wrapped in a sheet material (aluminium foil or simply paper, for example), according to various techniques known in the art. The conditions under which such products are eaten normally demand that the wrapping be removed, either as a whole or in stages, thereby opening the product in order to eat it. In many cases, however, the opening of the product proves to be a separate event which precedes the time of eating it: this situation typically occurs when the person buying or receiving the item as a gift (most often a child) wants to open the product to get at the surprise which it contains. It may not be easy to open the item, often causing it to break, with pieces or fragments being dispersed.

The object of the present invention is to provide an arrangement which overcomes this problem, without compromising the typical operations described above.

This object is achieved according to the present invention by providing a method having the characteristics specifically claimed in the claims which follow.

The invention also relates to the products which may be manufactured according to the said method.

In general terms, the invention is based on the recognition of the fact that in traditional products (see, for example, traditional Easter eggs or the product described in U.S. Pat. No. 3,961,089) the need to seal together the halves or parts constituting the product is dictated above all by the necessity of maintaining its coherence while wrapping it: in order, in other words, to prevent the product from coming apart while it is being wrapped.

This requirement is not, however, appreciated at the time of consumption, when the fact that a closed product must be opened or broken into before being eaten is often a nuisance.

For this reason, in broad terms, the invention aims to supply a food product made up of several parts substantially coupled together (the significance of this phraseology will be explained later) and held together by the wrapping. This ensures that when the wrapping is removed, the said parts are easily separated, with no risk of breakage or dispersal.

Figure 4:
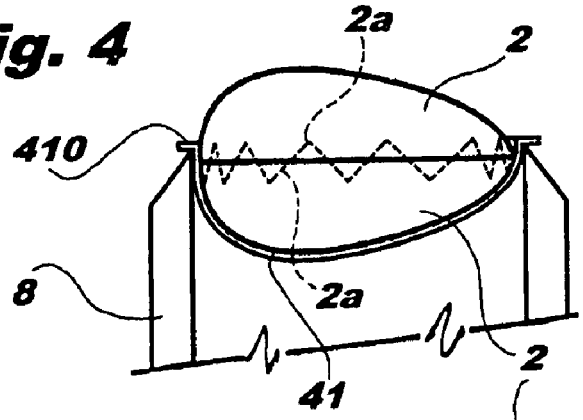
Figure 5:
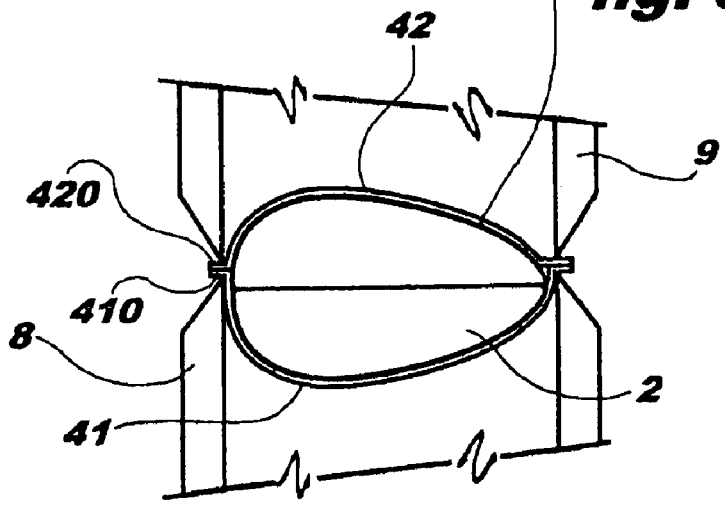
Figure 6:
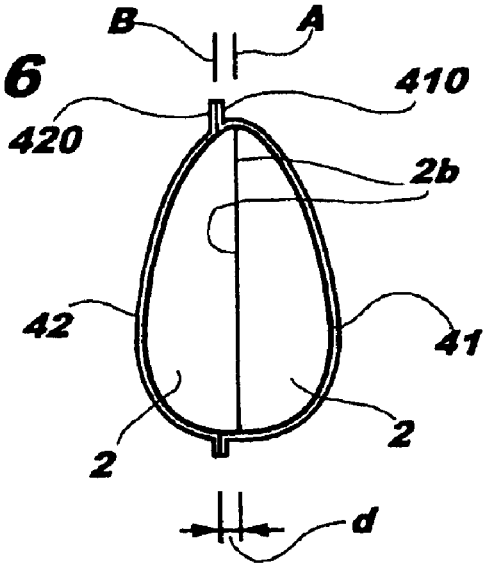

The invention will now be described, purely by way of non-limitative example, with reference to the appended drawings, in which:

FIG. 1 schematically illustrates the structure of a product to which the present invention is applicable;

FIGS. 2 to 5 schematically illustrate successive phases of a possible way of performing the method of the invention; and FIG. 6 shows the result which can be achieved with the said method.

In FIG. 1, the reference numeral 1 generally indicates a food product constituted, in the embodiment illustrated, by a food product comprising two half-shells 2 of a comestible material such as chocolate, for example. The half-shells 2 can be coupled by their respective mouth portions 2*a* thereby forming a hollow casing of edible material able to contain a so-called "surprise", possibly enclosed in a container indicated 3. The item is substantially similar, in other words, to a food product sold under the name "Uovo Kinder" by companies of the Ferrero group.

From the above description, it will be abundantly clear to those skilled in the art that the invention is in no way restricted to products 1 having this specific structure.

Without attempting to give an exhaustive picture, it is clear that many variants of the product 1 are possible, involving the following characteristics, among others:

- the shape of the product: it is evident that there is no restriction on the shape of the product 1 which could, for example, be spherical, ellipsoid, prismatic or the like rather than egg-shaped;
- the structure of the product: it will be appreciated that the advantages of the invention continue to exist even if one or more of the parts constituting the body of the product 1 (in the example illustrated the half-shells 2) are solid rather than hollow; as an immediate example, one could cite the small chocolate eggs (1.5–2 cm) currently manufactured and sold by various companies;
- the symmetry, i.e. equality of the parts making up the body of the product: in the example to which FIG. 1 relates, the two half-shells 2 are of identical shape and size; however, the invention is also applicable to products which do not meet this condition: as an example, one could envisage a product which is substantially similar, in its end state, to that illustrated by FIG. 1 but which, instead of being constituted by two half-shells of the casing coupled by mouth portions 2*a* which extend around and are coupled together in a "meridian" plane, is constituted by two shells, one half spherical and the other "ogival", with respective mouth portion extending and coupled in an "equatorial" plane of the casing;
- the number of parts of which the body of the product is composed: it is easy to see that the description which follows could be applied equally to an egg-shaped product, for example, constituted by two pairs of parts (that is four parts in all) instead of by two half-egg shaped parts, with each pair constituting together one of the said half-shells 2;
- the structural characteristics of the product: in the "Uovo Kinder" product mentioned earlier, for example, the casing has a layered structure, with an outer layer of chocolate and an inner one of a milk based cream or paste; it is clear that such variations do not affect the specific nature of the invention, to the extent that the casing of the product could also be made of a partly comestible material; and
- the presence or absence of items (such as the container 3) inside the product 1.

It is equally clear that the aforesaid variations—cited purely by way of example—could be present either singly or in combination.

The description which follows will refer however, for the sake of simplicity, to a product of the type illustrated in FIG. 1, comprising therefore an egg-shaped hollow casing constituted by a pair of half-shells 2 of identical shape and dimensions. The product in question is intended to be wrapped in a covering constituted by two corresponding half-shells of sheet material (aluminium foil, for example), indicated 41 and 42, respectively. As will be seen more clearly later, the shape and dimensions of the two parts 41, 42 of the wrapping are, overall, more or less complementary to the shape and dimensions of the half-shells 2. It follows that what was stated above with regard to possible variants of the product, extends also, when applicable, to the wrapping of sheet material and to the parts of which it is composed.

Figure 2:
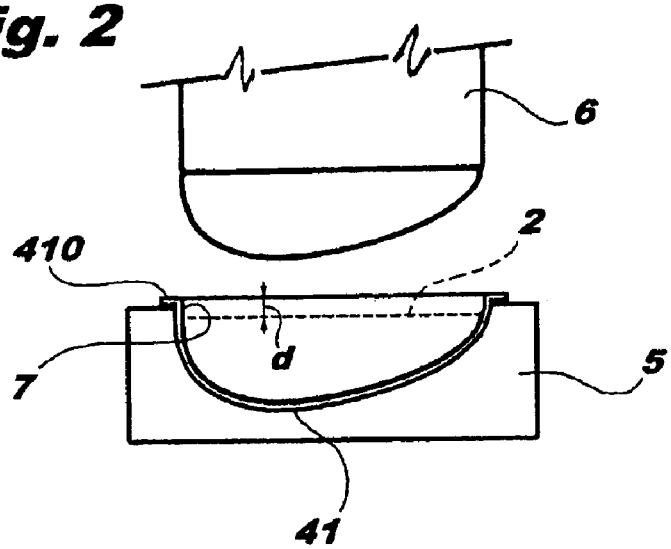

FIG. 2 illustrates a first step in the procedure of the invention. This step involves the moulding of the first part 41 of the sheet wrapping inside a mould 5. The part 41 is shaped so that it generally complements the external shape of one of the half-shells 2 (indicated by a broken line).

This moulding operation is intentionally shown only schematically since, in the preferred embodiment of the invention, the sheet material is shaped between the mould 5 and a male element or die 6 able to penetrate the cavity of the mould 5 and give the wrapper 41 the desired shape. The technique, along with possible variations, is well known in the art and does not require a detailed description here: it might prove useful, however, to consult the document WO-A-93/1093 which illustrates the possibility of putting the wrapping part 41 through a preliminary pleating operation aimed at making it easier to shape without tearing.

The operation of shaping the part 41 is preferably carried out so as to let a border or flange 410, which extends along the profile of the mouth portion of the wrapper part 41, project from the profile of the mouth portion of the cavity of the mould 5.

Whether or not there is a border 410 (which constitutes a preferential but not vital characteristic of the invention) , the moulding operation is carried out (taking into account the external shape of the half-shell 2 to be accommodated) in order that the wrapper part 41 can contain the said half-shell 2 (FIG. 2) while ensuring that the mouth portion of the part 41 (that is the portion surrounded by the border 410) extends upwards, forming a sort of collar 7 extending over the half-shell 2 itself. The purpose of this choice will become clear later.

Figure 3:
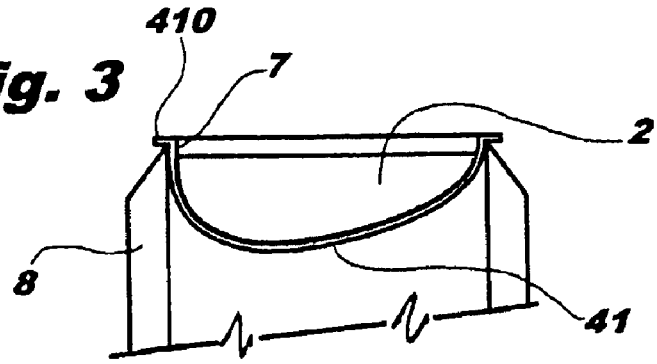

From observation of FIG. 3, it is clear, furthermore, that the illustration of the introduction of the half-shell 2 into the wrapper part 41 has assumed that the wrapper 41 is supported during this operation by a support element 8 other than the mould 5 in which the part 41 was formed.

This arrangement (whereby the wrapper part 41 is extracted from the mould 5 in which it was formed and transferred to the support element 8) is not obligatory, since the half-shell 2 could be fitted into the wrapper 41 while this was still in the mould 5.

If the wrapper part 41 is to be moved, this would be carried out by suitably gentle gripper elements, not illustrated, such as vacuum suckers known in the art, for example. This operation would enable one of the parts (such as the so-called anvil or sonotrode) of an ultrasonic sealing system to be used as the support 8, the system being used, as better explained later, to seal the wrapper around the product 1. However, as stated earlier, the mould 5 and the support 8 could well be one and the same, even in respect of a role in an ultrasonic sealing system.

FIG. 4 illustrates a subsequent step in the method of the invention, whereby the other half-shell 2 constituting the body or casing of the product 1 is placed over the other half-shell 2, which has already been fitted into the wrapper 41, so the two openings fit together (with the two mouth portions 2*a* being coupled together).

As when fitting the first half-shell 2 into the wrapper part 41, this operation can be carried out by means of a gripper device, for example a vacuum sucker, or by any handling system currently used in the art, in the food industry, for example.

The presence of the collar 7 proves an advantage from several points of view.

First, the collar 7 constitutes a guide element which enables half-shell 2 shown in FIG. 4 to be moved into a position over the other half-shell with the two openings exactly aligned, thus avoiding any misalignment.

Secondly, the collar 7 provides a slight grip or engagement action on the half-shell 2 shown in the upper position. This means that, once the two half-shells are coupled together, they retain their relative positions without being moved and without any need for an actual welding operation (as is required in prior art arrangements) to hold the two mouth portions 2*a* of the half-shells 2 together.

In the arrangement of the invention, the two half-shells are coupled together substantially freely (along the coupling line defined by the two mouth portions 2*a*), in the sense that the two half-shells can be freely separated (an aspect which, as will be seen later, is important at the time of consumption) since they are held together by the wrapper and, significantly, by the collar 7 formed by the wrapper portion 41, as shown in the operation of FIG. 4.

The phrase "coupled together substantially freely" is used because under certain environmental conditions (depending on the temperature and/or the material constituting one or both of the half-shells 2: materials such as chocolate or milk based cream, for example, which have a low melting point), the mouth portions 2*a* of the half-shells may fuse together. Any adhesion will not be strong, however and would not, one the one hand, prevent relative movement of the two half-shells 2 during handling or, on the other hand, in any way prevent the two half-shells 2 from being separated to be eaten.

In FIG. 4 in particular, a broken line illustrates a possible embodiment of the invention in which, instead of having a generally smooth profile, the mouth portions 2*a* of the half-shells 2 have complementary shaped profiles, which may be zigzag, wavy or toothed, for example. The use of mouth portions 2*a* having such profile may be suggested by the desire to provide additional means, which in addition to collar 7, hinder the relative movement of the two half-shells 2.

This characteristic may prove desirable, for example, if the two half-shells 2 are to be held with the said portions 2*a* in a vertical rather than a horizontal plane as shown in FIG. 4.

FIG. 5 illustrates the operation which completes the wrapper enclosing the product 1 formed by the two half-shells. An additional portion of the wrapper 42, formed by the same method used for the part 41, for example, and thus having a flanged border 420 around its mouth portion, is positioned to cover the half-shell 2 in the upper position and then the two parts 41 and 42 of the wrapper are connected welding along the borders 410, 420 around their mouth portions.

The said welding operation along the connection line defined by the borders 410, 420 (and in particular by the inner edges thereof) may be carried out to advantage by known means such as ultrasonic welding, using a device 9 which works as a sonotrode or anvil and complements the action of the element 8, previously presented primarily as a support.

It is clear that the two parts 41 and 42 of the wrapper could be joined in other ways: by heat welding, for example, or by gluing with additional material or by other methods known to specialists in the field and currently used in the food industry in particular. It will be appreciated in this context that the presence of the flanged borders 410, 420 is preferred but in no way essential in order to achieve the object of the invention. The two parts 41 and 42 of the wrapper could be made without these borders with a view to using a different method of connection, such as engagement or gluing of the respective mouth portions.

With regard to the formation of the part 42 of the wrapper, it will be appreciated that any (preliminary) shaping of it in accordance with the criteria described with reference to the part 41, possibly preceded by a pleating operation as described in WO-A-93/1093, constitutes a preferential but not obligatory operation. The part 42 of the wrapper could be formed, for example, by applying a flat sheet of wrapping material onto the half-shell 2 to be covered by the part 42, so that this sheet assumes a complementary shape by virtue of the movement by which it is applied to the said half-shell 2. In particular, this shaping action can be achieved, if appropriate, simply by lowering an element such as the welding device 9 into its final position for closure of the wrapper.

The end result of the packaging operation described above is illustrated in FIG. 6.

It can be seen from this drawing, in which the effect is emphasized for the sake of clarity, that the plane, indicated A, in which the freely coupled mouth portions 2*a* lie which define the coupling line between the two half-shells 2 and the other plane, indicated B, in which the facing and sealed borders 410 and 420 lie which define the connection line between the two parts 41 and 42 of the wrapper, are offset. The amount by which they are offset, indicated d, corresponds in practice to the height, indicated by the same reference number, of the collar 7 shown in FIG. 2.

In the embodiment illustrated, the two half-shells 2 forming the casing of the product 1 are identical, while the parts 41 and 42 of the wrapper are not. Specifically, the part 41 is larger than the part 42 by an amount identified by the amount d by which they are offset.

Thanks to the fact that the coupling lines of the half-shells 2 (plane A) and the connection lines of the wrapper parts 41, 42 (plane B) are offset, the two half-shells 2 are held together by the wrapper formed by the parts 41 and 42. As a result of this, although the half-shells 2 are not really joined together (or bonded) any relative movement, such as relative sliding of the mouth portions 2*a* in their common plane, caused by forces acting on the packaged product, is prevented.

In the specific embodiment illustrated in FIGS. 2 to 5, the aforesaid offset arrangement is identified by the fact that the planes A and B defined above extend parallel to each other spaced by a distance equal to the amount d by which they are offset. In the case of a product 1 having the shape and dimensions of a normal chicken's egg, this degree is tiny, of the order of a couple of millimeters or less.

This offset effect (in which the planes do not coincide) could also be achieved in other ways than that described with reference to the aforesaid embodiment.

The offsetting could be angular, for example, achieved by ensuring that the planes A and B cross each other (by being orthogonal, for example) along an axis extending in the connection direction between the two polar regions of the product 1: in practice, by ensuring that the mouth portions 2*a* of the half-shells 2 are coupled along a (free) coupling line lying in a plane rotated through 90° with respect to the said polar axis in comparison with the position shown in FIG. 6, nevertheless maintaining the same orientation of the plane containing the connection line (borders 410, 420) between the two wrapper parts 41 and 42.

It is possible to produce an item of this type by following a variation of the method illustrated with reference to FIGS. 2 to 5, that is by shaping the part 41 and fitting into it the two half-shells 2 rotated through 90° compared to the position shown in FIGS. 3 to 5 (that is with the mouth portions 2*a* lying in a vertical rather than a horizontal plane) and then closing the wrapper as shown in FIG. 5. It is clear that in this case it is no longer necessary to have parts 41 and 42 of different sizes, since the two half-shells 2 are prevented from sliding relative to each other by their arrangement inside the wrapper part 41.

It will also be appreciated (in particular with reference to FIG. 4) that the aforesaid offsetting of the line along which the two half-shells 2 are freely coupled and the line along which the corresponding parts 41 and 42 are joined can also be achieved without offsetting the planes thereof (their alignment or angular positions) but simply by ensuring that, while the paths of the said lines are substantially coextensive, they do not coincide. If the edges of the mouth portions 2*a* are zigzag or wavy (or toothed), as shown by the broken line of FIG. 4, any relative sliding of the two half-shells 2 is prevented by their engagement (even without welding), thus eliminating the need for the collar 7 shown in FIG. 3 and/or for rotation of the half-shells 2 relative to the orientation shown in the drawings.

Naturally, the principle of the invention remaining unchanged, manufacturing details and embodiments may vary broadly from those described and illustrated, without departing thereby from the scope of the invention, as claimed in the following claims.

What is claimed is:

1. A method for wrapping a food product in a wrapper comprising sheet material; said food product comprising at least two complementary parts that are capable of being coupled together along a coupling line, said wrapper comprising at least two complimentary parts which can be joined together along a respective connection line; said method comprising:

A) selecting one of the said parts of said food product;

B forming one part of the at least two parts of the wrapper to be shaped and dimensioned to generally complement at least a portion of the external shape of said product and introducing the said selected one part of the product into the formed, said one part of the wrapper so that at least part of the said one part of the wrapper projects beyond the selected one part of the product, then coupling, along said coupling line, the others of said at least two parts of said food product to said selected one part of said food product, to form said food product, said coupled parts of said food product being aligned, but coupled together substantially freely, along said coupling line extending around a periphery of said food product with relative movement between said selected one part of said food product and said at least two parts of said food product being prevented by the projecting portion of said one part of said wrapper, then forming the other parts of the at least two parts of said wrapper along the respective said connection line to form said wrapper, so that the wrapper encloses the coupled food product, which formed wrapper is shaped and dimensioned to complement the shape and dimensions of the coupled food product such that said parts of said food product are maintained coupled together substantially freely in the sense that the coupled part can be freely separated once the wrapper is removed from enclosing said coupled product such that at least a portion of said coupling line is offset with regard to the connection line.

2. A method according to claim 1, comprising the steps of:

forming at least one further part of the said wrapper, joining it to the said one part of the wrapper along the respective connection line.

3. A method according to claim 1, comprising the steps of:

closing the said wrapper around the said product at the respective connection line.

4. A method according to claim 1, wherein the said offset effect is achieved by forming at least one of the coupling line and the connection line as a wavy line.

5. A method according to claim 1, comprising the steps of:

making the said one part of the wrapper generally concave so that the said projecting portion of the wrapper is substantially a collar able to surround and project from the said selected part of the product.

6. A method according to claim 1, comprising the steps of:

making the one part of the wrapper larger than the other part of the wrapper.

7. A method according to claim 1, comprising forming said parts of the said wrapper as portions of sheet material having respective flanged edges which jointly define a respective connection line.

8. A method according to claim 7, wherein said two wrapper parts are joined along their respective connection line in an operation selected from the group consisting of:

ultrasonic welding, heat welding, and gluing.

* * * * *